US006415922B1

(12) United States Patent
Lee

(10) Patent No.: US 6,415,922 B1
(45) Date of Patent: Jul. 9, 2002

(54) TOOL CASE WITH MOVABLE INSERT

(76) Inventor: Benny Lee, 1300 NW. 43rd, Kansas City, MO (US) 64116

( * ) Notice: Subject to any disclaimer, the term of this patent is extended or adjusted under 35 U.S.C. 154(b) by 0 days.

(21) Appl. No.: 09/574,817

(22) Filed: May 19, 2000

(51) Int. Cl.[7] ..... B65D 85/20; B65D 25/10

(52) U.S. Cl. ..... 206/372; 206/373; 220/528; 220/529; 220/533; 220/534

(58) Field of Search ..... 206/370, 372, 206/373, 472, 473; 220/528, 532, 533, 552, 529, 534

(56) References Cited

U.S. PATENT DOCUMENTS

| | | | | | |
|---|---|---|---|---|---|
| 2,695,112 | A | * | 11/1954 | Bonnevay | 220/528 |
| 4,261,464 | A | * | 4/1981 | Maitland | 220/533 |
| 4,261,465 | A | * | 4/1981 | Thomas | 220/533 |
| 4,838,445 | A | * | 6/1989 | Lanius | 220/533 |
| 4,884,689 | A | * | 12/1989 | Su-Chin | 206/372 |
| 5,454,478 | A | * | 10/1995 | Everson | 220/528 |
| 5,826,719 | A | * | 10/1998 | Chen | 206/373 |

FOREIGN PATENT DOCUMENTS

| | | | | | |
|---|---|---|---|---|---|
| FR | 1031360 | A | * | 6/1953 | 206/369 |
| FR | 1565411 | A | * | 5/1969 | 220/528 |

* cited by examiner

*Primary Examiner*—Bryon P. Gehman
(74) *Attorney, Agent, or Firm*—Chase Law Firm, L.C.

(57) ABSTRACT

A tool case includes first and second housings pivotal about a central spine to present a book-shaped configuration. Within each housing are walls having a plurality of post-shaped flanges therealong. A tool accessory tray includes a shelf having recesses for a snap fit engagement of the particular tool accessory therein. At the opposed end of the shelves are recesses for slidably seating the flanges therein so as to releasably maintain the tray within the housing. The tray type and number may thus be varied for releasable seating within each housing.

15 Claims, 3 Drawing Sheets

TOOL CASE WITH MOVABLE INSERT

BACKGROUND OF THE INVENTION

This invention relates to tool cases and, more particularly, to a padded tool case for releasably engaging a plurality of various tool accessories therein.

It is desirable to transport various types of tool accessories, such as drill bits, sockets, screwdriver shanks, rotary bores and the like. However, past containers for tool accessories have stored only a single type of tool accessory. The containers did not allow for the transport of various tool accessory types or allow one to vary the number of accessories to be transported. Moreover, the tool cases did not utilize a releasable cover thereon which protects the case but can be easily removed for maintenance or other aesthetic purposes.

In response thereto I have invented a tool case which utilizes a plurality of removable trays with each tray adapted to seat a particular type of tool accessory therein. Each tray is releasably engageable within the tool case so that the number and/or configuration of the trays can be easily varied according to the type and/or number of tool accessories to be stored within the case.

My device presents first and second housings pivotal about a central spine. Within the interior of the housings are a plurality of post-like flanges which are designed to seat within recesses at the opposed ends of a tray. This complementary structure allows the trays to be releasably seated within each housing. Thus, the tray type ad/or number can be varied according to the type and/or number of tool accessories. A releasable cover presents protruding snaps for releasable engagement with apertures oh the exterior walls of the housings. A zipper about the cover allows the tool case to be secured for transport.

It is therefore a general object of this invention to provide a tool case for storage and/or transport of various tool accessories therein.

Another object of this invention is to provide a tool case, as aforesaid, which has a releasable cover thereon.

A further object of this invention is to provide a tool case, as aforesaid, which releasably receives tool accessory trays therein with each tray designed for engaging a particular tool accessory.

Another object of this invention is to provide a tool case, as aforesaid, wherein the trays may be relatively positioned within the confines of the tool case.

Still another object of this invention is to provide a tool case, as aforesaid, wherein the type and/or number of trays releasably engaged within the tool case may be varied.

A further object of this invention is to provide a tool case, as aforesaid, in which the tool case and trays are complementary designed for a releasable seating therebetween.

Other objects and advantages of this invention will become apparent from the following description taken in connection with the accompanying drawings, wherein is set forth by way of illustration and example, a now preferred embodiment of this invention.

DESCRIPTION OF THE PREFERRED EMBODIMENT

Figure 1:
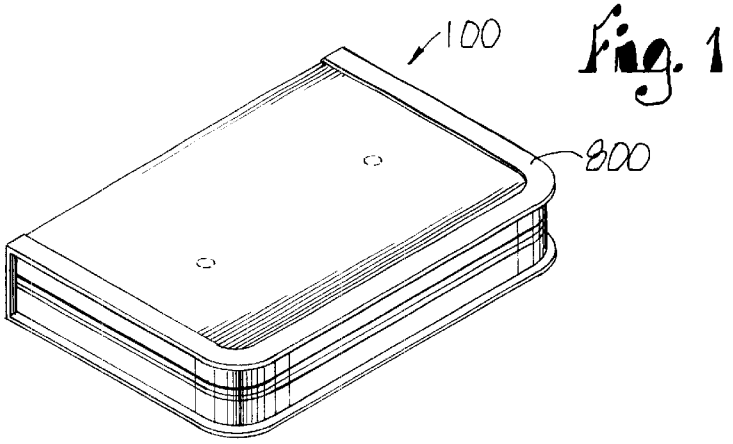
FIG. 1 is a perspective view of the tool case in a closed position.
Figure 2:
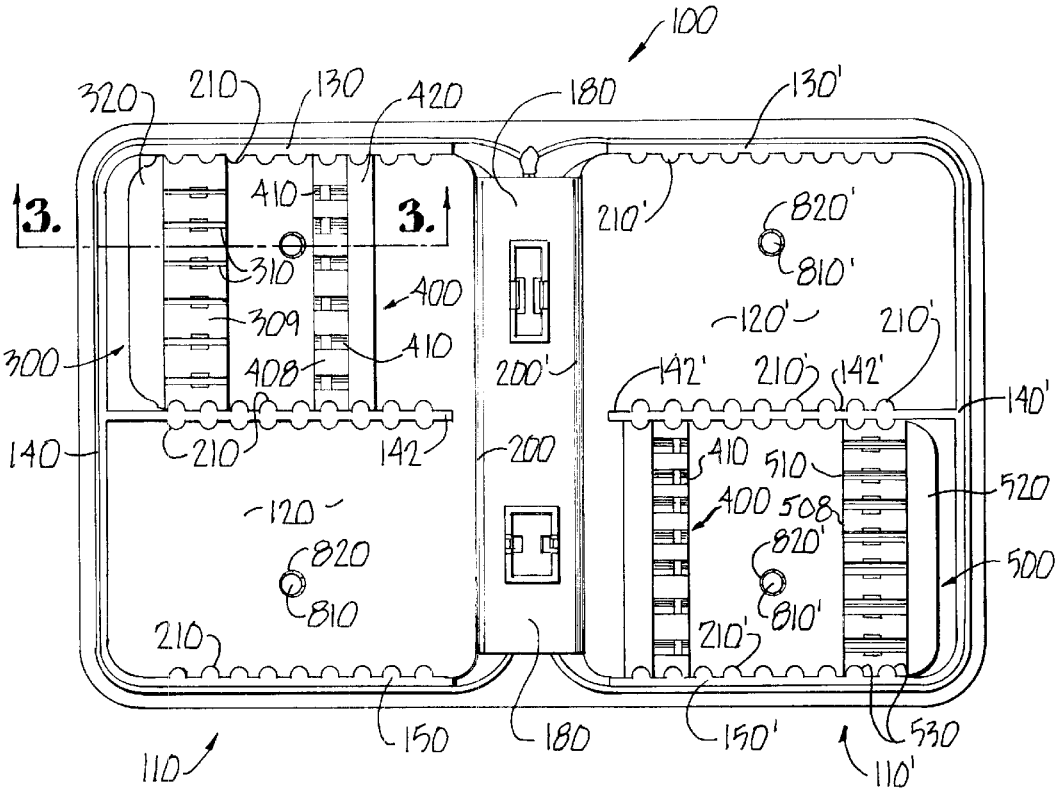
FIG. 2 is an enlarged view of the tool case in an open position.

Turning more particularly to the drawings, FIG. 1 shows a now preferred tool case 100 as having a book-like configuration in its closed position. FIG. 2 illustrates the case as having a central spine 180 flanked by first 110 and second 110' housings. (Prime numbers are used in the drawings to indicate identical parts in housing 110'.) Each housing 110, 110' has a base 120 which also serves as an exterior wall of the closed case 100. Each base 120 is surrounded on three sides with upstanding vertical walls 130, 140, 150. The walls, preferably made of a plastic material, include bottom 130 and top 150 laterally extending walls with an end wall 140 longitudinally spanning therebetween. Between the bottom 130 and top 150 walls is an intermediate laterally extending wall 142. The housings 110, 110' are relatively configured so that one housing nests within the other upon folding each housing along a pivot axis 200 formed by the juncture of the housing with spine 180.

Figure 3:
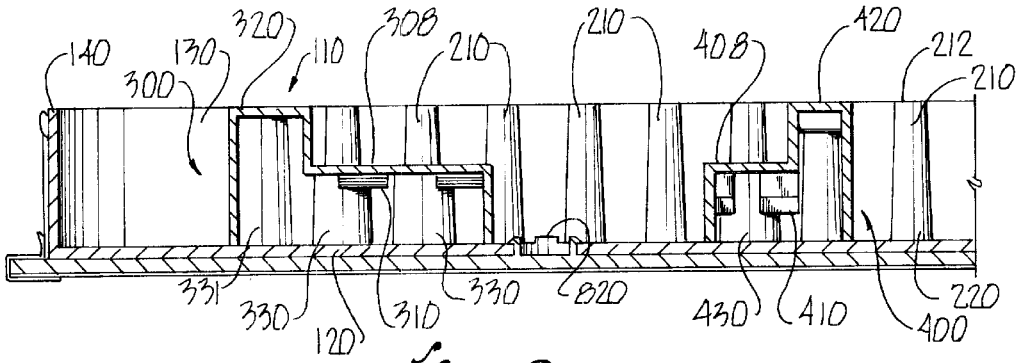
FIG. 3 is a view on an enlarged scale, taken along line 3—3 in FIG. 2.
Figure 4:
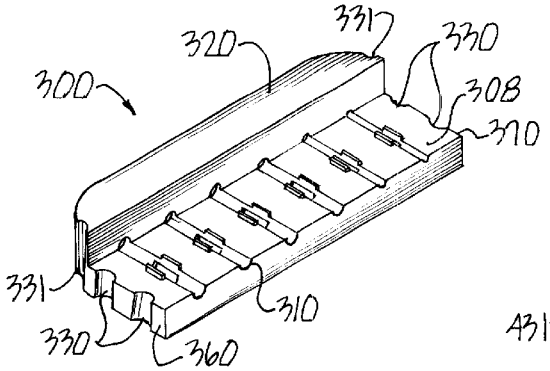
FIG. 4 is a perspective view of a first tray type removed from the tool case.
Figure 5:
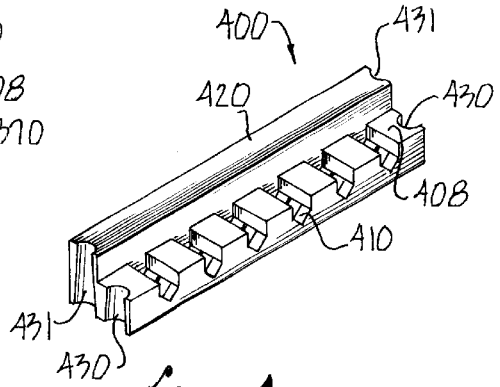
FIG. 5 is a perspective view of a second tray type removed from the tool case.

As shown each wall 130, 142, 150 of each housing has a plurality of spaced-apart semicircular post-like flanges 210 integrated along the surface thereof. Each post-like flange 210, being generally semicircular in configuration, has a radius which increases from the top 212 to the bottom 220 thereof (FIG. 3) for a purpose to be subsequently described. Also, slots 482 may be provided at the bottom of each wall between the post-like flang 210 and adjacent the base 120. The slots 482 are to receive flanges 480 found at the to be described tray ends.

Figure 6:
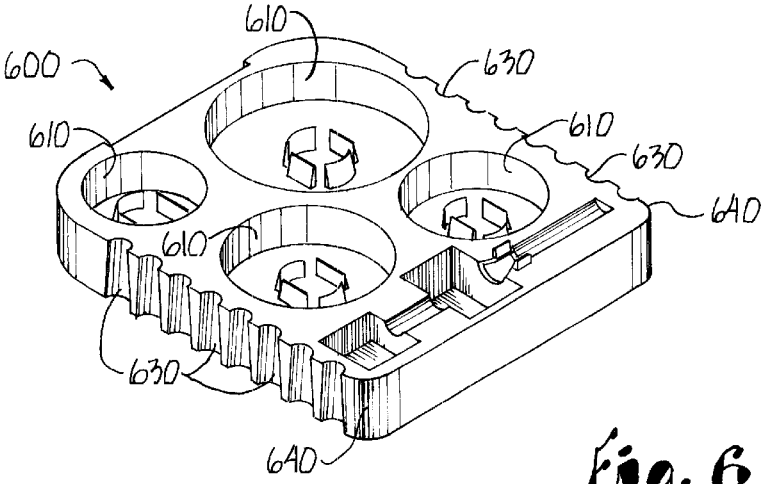
FIG. 6 is a perspective view of a third tray type removed from the tool case.

A plurality of trays 300, 400, 500, 600 are provided which are configured to seat a particular type of tool accessory therein. Each tray 300, 400, 500 includes a shelf-like portion 308, 408, 508 having a plurality of recesses therealong 310, 410, 510. The recesses are configured to provide a friction fit engagement for the particular tool accessory therein such as a drill bit, screwdriver shanks, etc. Tray 600 (FIG. 6) is shown having circular seats 610' for receiving circular rotary bores therein. Each shelf 308, 408, 508 extends from an upstanding support wall 320, 420, 520.

In the opposed end walls of the storage shelf, e.g., 360, 370, are vertically extending recesses 330, 430, 530. Recesses 630 are also located in the opposed end walls 630, 640 of tray 600. A partial recess is also located in the opposed end walls of support wall 320 and 520 with a full recess in the opposed end walls of support wall 420 of tray 400. These recesses present seats for slidably receiving the above-described semicircular posts 210 therein. Each recess/seat also increases in radius from the top to the bottom thereof to conform to the same increase in post radius. Accordingly, the recesses at the end of each tray shelf slidably receive at least one post or a portion of the post therein. Upon sliding a tray to the base a snug engagement of the tray between the bottom wall 150 and the intermediate wall 142 or between top wall and the intermediate wall is provided by the post/recess seating. A pair of recesses at each opposed end of each tray is preferred to enhance this snug tray/wall engagement.

Figure 7:
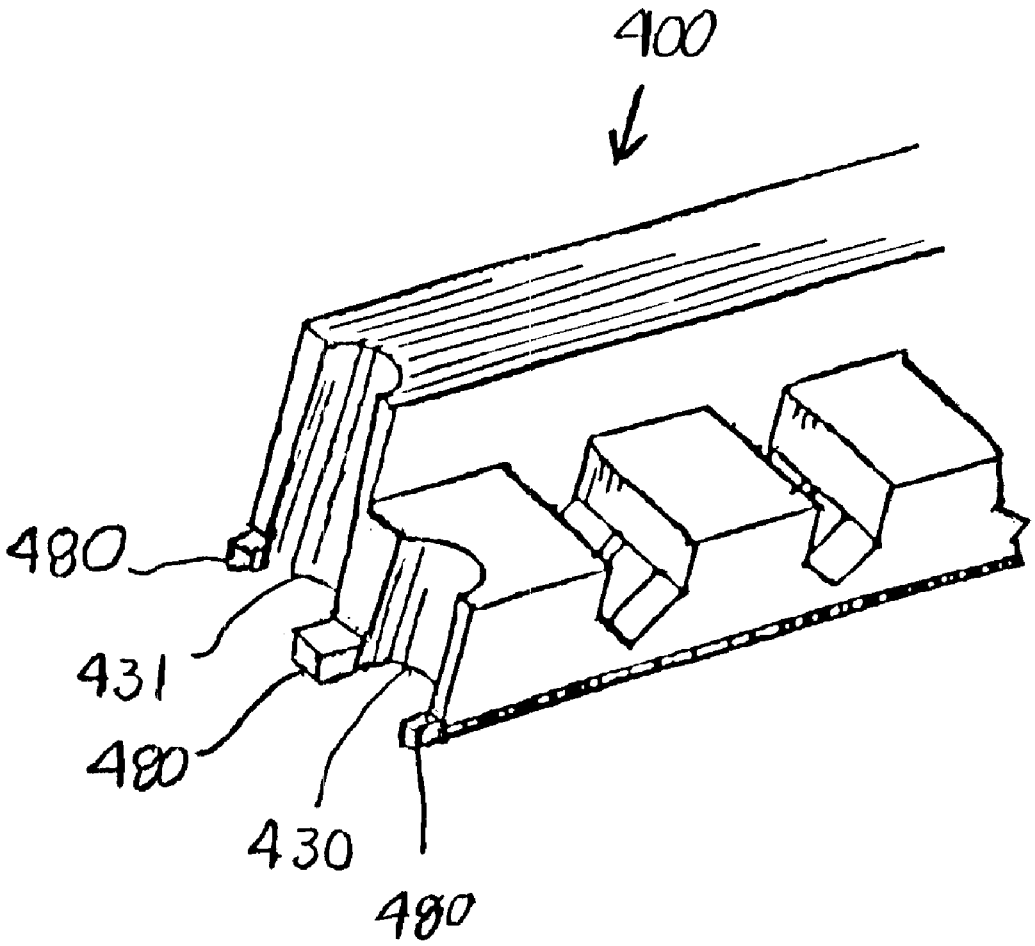
FIG. 7 is a fragmentary end view of the tray of FIG. 5, on an enlarged scale, with additional locking flanges shown at one end thereof, it being understood that similar flanges may be at the opposed tray end.

As shown in FIG. 7 flanges 480 at each end of the trays may also be provided. Upon sliding a tray to the base 120 these flanges 480 will seat within the slots 482 at the wall base 120. Thus, it is preferred that the walls be made of a yieldable material to allow for such seating and subsequent unseating.

As above described the tray includes either full or partial recesses in the opposed ends of the support wall to present seats for maintaining a tray within the confines of the particular housing and between the walls thereof, it being understood that the number of walls therein may be varied. Along each tray shelf or within the tray the particular tool accessory may be releasably seated within the particular recess in a friction fit engagement therewith.

Accordingly, the type of trays and/or the number of trays may be varied according to the tool accessory type and/or number of tool accessories to be stored. Thus, drill bits, sockets, screwdriver shanks, rotary bores and the like may be selectably stored therein. Thus trays for storage of particular tool accessories may be designed and releasably engaged within the tool case by the above-described flange/seat. Also various types of housings 182, 184 may be positioned along the spine 180 or within the trays so as to snap fit particular types of tool accessories therein.

It is understood that my invention need not be limited to the type of tool accessory to be stored within the tray or the number of trays stored therein.

The tool case may be provided with a padded cover 800 releasably engaged thereto by means of shanks 810 extending from the cover 800 for releasable engagement within apertures 820 located in the housing bases 120, 120'. Upon pivoting one housing 110' so that it nests within the other 110' the cover 800 may then be zipped so as to secure the tool case in its closed book-like configuration (FIG. 1) for further transport.

It is to be understood that while certain forms of this invention have been illustrated and described, it is not limited thereto, except in so far as such limitations are included in the following claims.

What is claimed is:

1. A tool case for transport of tool accessories comprising:

a first housing having a base;

a second housing having a base;

first and second spaced-apart walls extending from at least said base of one of said housings;

a plurality of flanges extending from said walls in said one of said housings;

a spine intermediate said first and second housings, each of said first and second housings joined to said spine along a line of juncture extending along said spine in pivotal movement about said line of juncture between an open position and a closed position wherein one housing faces the other housing;

a tray adapted for storage of a tool accessory therein, said tray comprising:

means in said tray for releasably engaging the tool accessory therein;

means on said tray for a releasable seating with one of said flanges on each of said first and second walls in said one of said housings, whereby to maintain said tray between said walls and within said one housing.

2. The tool case as claimed in claim 1 wherein said flanges comprise a post having a first top end and a second bottom end.

3. The tool case as claimed in claim 2 wherein said post tapers between said first and second ends.

4. The tool case as claimed in claim 1 wherein said seating means comprises a pair of recesses on said tray for receiving one of said flanges on each of said walls therein.

5. The tool case as claimed in claim 1 further comprising an intermediate wall between said first and second walls; a plurality of flanges on opposed sides of said intermediate wall, said seating means on said tray for engagement with one of said flanges on said first or second wall and one of said flanges on said intermediate wall.

6. The tool case as claimed in claim 1 further comprising:

a plurality of slots along said walls in said one of said housings;

at least one flange on said tray for releasably seating within a respective one of said slots, whereby to maintain said tray between said walls and within said one housing.

7. The tool case as claimed in claim 1 further comprising:

a cover about said housings;

means for a releasable engagement of said cover with said housings.

8. A tool case for transport of tool accessories comprising:

first and second housings, each housing comprising:

a base;

first and second spaced-apart walls extending from said base;

a plurality of flanges extending along said walls, each said flange presenting a first configuration;

at least one tray having first and second ends for storage of a tool accessory therein, each said at least one tray comprising:

means in said tray adapted for releasably engaging the tool accessory therein;

means on said at least one tray having a second configuration complementary with said first flange configuration for a releasable seating with at least one of said flanges on said first and second walls of at least one of said housings, whereby to releasably maintain said at least one tray between said walls and within said at least one of said housings.

9. The tool case as claimed in claim 8 wherein said flanges comprise a post having a first top end and a second bottom end.

10. The tool case as claimed in claim 8 wherein said seating means comprises a pair of recesses on said tray for receiving one of said flanges on each of said walls therein.

11. The tool case as claimed in claim 8 further comprising an intermediate wall between said first and second wall; a plurality of flanges on said intermediate wall, said seating means on said tray for engagement with one of said flanges on said first or second walls and with one of said flanges on said intermediate wall.

12. The tool case as claimed in claim 8 further comprising:

a plurality of slots along said walls;

at least one flange on said at least one tray for releasably seating within a respective one of said slots, whereby to maintain said tray between said walls and within said housing.

13. A tool case for transport of tool accessories comprising:

a housing having a base;

first and second spaced-apart walls vertically extending from said base;

a plurality of flanges extending along said walls, each of said flanges presenting a first configuration;

a plurality of slots in said walls and each slot between adjacent flanges of said flanges;

a tray having first and second opposed ends, said tray adapted for storage of a tool accessory therein, said tray comprising:

a plurality of recesses in said tray for releasably engaging the tool accessory therein;

at least one seat on at least one of said opposed ends of said tray for a releasable seating with a respective one of said flanges on at least one of said walls;

at least one flange on at least one of said opposed ends of said tray for seating within one of said slots adjacent said respective one of said flanges on said walls.

14. The tool case as claimed in claim 13 further comprising a third wall intermediate said first and second walls; a plurality of flanges on opposed sides of said third wall; a slot between said flanges on said third wall, whereby said at least one seat and said at least one flange on said tray respectively engages said respective one of said flanges and slot therebetween on said first and third walls or on said second and third walls.

15. A tool case for transport of tool accessories comprising:

a housing having a base;

first and second spaced-apart walls vertically extending from said base;

a plurality of spaced-apart flanges extending from each of said walls;

a slot positioned between adjacent spaced-apart flanges extending from each of said walls;

a tray having first and second opposed ends, said tray adapted for storage of a tool accessory therein, said tray comprising:

a plurality of recesses along said first and second ends of said tray for a complementary engagement with said flanges extending from said first and second walls;

a flange extending from said first and second opposed ends of said tray for respective engagement with said slots in said respective first and second walls, whereby to releasably maintain said tray between said walls and in said housing.

* * * * *